United States Patent [19]

Brugman

[11] 4,095,385

[45] Jun. 20, 1978

[54] DEVICE FOR SECURING PANELS IN A SUSPENDED CEILING OR WALL CONSTRUCTION

[75] Inventor: Johannes Antonius Hendrikus Brugman, Rotterdam, Netherlands

[73] Assignee: Hunter Douglas International N.V., Willemstad, Netherlands Antilles

[21] Appl. No.: 818,718

[22] Filed: Jul. 25, 1977

[30] Foreign Application Priority Data

Aug. 3, 1976 Germany ..... 2634774

[51] Int. Cl.[2] ..... E04B 5/52

[52] U.S. Cl. ..... 52/489; 52/493; 52/497; 52/499

[58] Field of Search ..... 52/500, 499, 498, 584, 52/493, 489, 549

[56] References Cited

U.S. PATENT DOCUMENTS

| | | | |
|---|---|---|---|
| 1,723,307 | 8/1929 | Sipe | 52/493 |
| 2,116,530 | 5/1938 | McCabe | 52/499 |
| 2,312,673 | 3/1943 | Rizzolo | 52/493 |
| 3,022,869 | 2/1962 | Radek | 52/489 |
| 3,336,705 | 8/1967 | Vecchiarelli | 52/497 |
| 3,548,557 | 12/1970 | Downing | 52/493 |

*Primary Examiner*—John E. Murtagh
*Attorney, Agent, or Firm*—Pennie & Edmonds

[57] ABSTRACT

The invention concerns a device for securely fastening panels of a suspended wall or ceiling construction having in-turned flanges at the sides of the panels, panel supports running transverse to the panels, hooks on the panel supports, on which hooks the flanges of the panels rest, and locking members positioned between each two adjacent panels to insure firm securement.

16 Claims, 13 Drawing Figures

DEVICE FOR SECURING PANELS IN A SUSPENDED CEILING OR WALL CONSTRUCTION

BACKGROUND OF THE INVENTION

Panels having in-turned flanges along their lateral sides engaged in hooks of transverse supports are not always secured solidly enough to insure that the attachment will withstand all conceivable loads. There are numerous instances in which external forces may cause the panels to become detached from the panel supports, particularly as a result of separation of the in-turned flanges.

In order to prevent this, there has hitherto been arranged a clamp, or locking member, in the space between two adjacent panels, which clamp extends from one panel to the other and acts as a spacer to prevent separation of the flanges and consequent detachment of the panels. The clamp has taken the form of a spring clip, which by reason of its resiliency can be hooked on the edges of the panel support. This hooking, however, has not always been reliable, so that accidental detachment of the spring clip is actually possible. In addition, panels with this type of attachment can not be attached such that rattling as a result of vibrations or the like, can be prevented with any certainty.

Vibration of the panels and their movement with respect to the panel supports accordingly, has not been adequately eliminated.

Even if, specifically, the distance between each hook and the panel support is made as close as possible, this distance must nevertheless remain at least great enough for the in-turned flanges of the panel support to be slipped over the hooks with sufficient ease. In such event, enough clearance still remains that external influences such as vibration, may set the panels into rattling.

SUMMARY OF THE INVENTION

Accordingly, one object of the invention is to provide a device that not only is quick and simple to attach between panels to insure against dislodgement of the panels, but also to provide a device that achieves reduction of the movement and rattling of the panels against the panel supports.

To this end the invention proposes that the locking member for use in the space formed between two adjacent panels be supported rotatably on the panel support and have at least one arm which engages, by reason of the rotary motion, between the panel support and the in-turned flanges and further that the locking member be locked in this position of engagement in relation to the panel support.

The arm of the locking member after one-quarter rotation engages the flange of a panel engaged over the associated hook in such a manner that the panel flange not only rests on the hook but in addition is pressed against the hook by the arm of the locking member. Such a solid connection is thereby produced between the panel supports and the panels that even if subjected to fairly strong external forces, such as jarring, they do not vibrate.

Described below are certain particularly advantageous embodiments of the invention in one of which the locking member has a center portion designed for the receipt of a turning tool and two radially, diametrically outwardly extending arms.

In this embodiment the locking member can easily be inserted into the space between two adjacent panels at the level of the associated hooks, while the center portion serves as a spacer and presses apart the panels engaged over the hooks. The arms of the locking member are engaged with a rotary motion over the in-turned flanges of the panels, so that the latter are pressed tightly against their respective hooks. The locking member is thus supported on the panel support.

It is advantageous if the arms of the locking member form a flange-like end piece of the same. It is further expedient if between the center portion of the end piece of the locking member and the panel support there is provided a guide formed of a projection and a depression. This guide serves to hold the locking member in its place and also to guide it during the rotary motion of assembly. It is also advantageous if the panel support has a web engaging in an approximately circular depression of the center portion of the end piece. Said web provides sufficient guidance and requires no particular effort in production. In addition, such a web when in clamped position engages in a depression formed in the end piece. As such, the web secures the locking member, when the latter is in its clamped position, even against twisting. Disassembly is facilitated if the walls of the slot are beveled.

It is moreover advantageous to use a panel support having an approximately U-shaped cross-section and, at the outer edges of the two side walls of the panel support, to design cut-out portions lying in the plane of the wall and providing hooks. These hooks may accordingly be formed, without additional operations, simultaneously with manufacture of the panel support and with no additional work being required.

In a modified embodiment the U-shaped panel support has, in a plane parallel to that of the panel and preferably bent over outward, side flanges which serve as bearing surfaces for the locking members and which may be provided with openings for stops provided on the locking member.

In other respects the center portion of the locking member should have a cross-section sized great enough substantially to fill up, at least in the locked position, the space between two adjacent panels. The panels are in this way also held from the side and made secure against loose fit or rattling.

BRIEF DESCRIPTION OF THE DRAWINGS

The invention is described in greater detail below and shown in the accompanying drawings, in which.

In the embodiment of FIGS. 1–7, a panel support 10 is attached in suitable fashion to a wall or ceiling 9 in any suitable manner, a screw being shown. Alternatively, the panel support 10 may be suspended from the ceiling 9 by suspension wires passing through openings 3 in the panel support 10 in well known manner.

Figure 3:
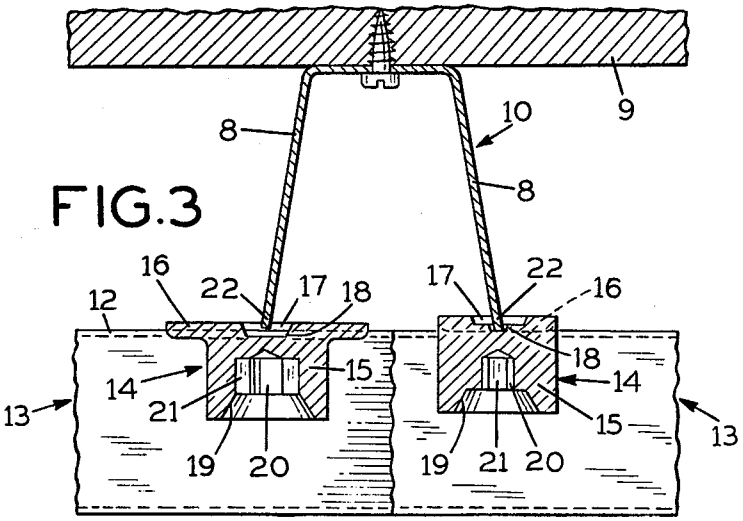
FIG. 3 is a vertical section along line 3—3 of FIG. 1.

The panel support 10, as may be seen especially in FIG. 3, is approximately U-shaped in cross-section, while the two side walls, at their free lengthwise edges have formed therein the hooks 11. The latter lie preferably in a plane with the associated side wall 8 of the panel support 10 in each instance and otherwise are sized and shaped in such manner that in-turned flanges 12 along the lengthwise edges of panels 13 may be engaged over them. By reason of the resiliency of the panels 13, the flanges 12 can be sprung far enough apart so that the flanges 12 may engage over the hooks 11 in the spaces 6 defined by the hooks 11 and edges 7 of cut-outs in the panel supports 10.

Figure 5:
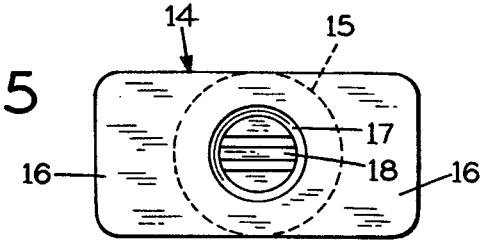
FIG. 5 is a plan view of the locking member.
Figure 8:
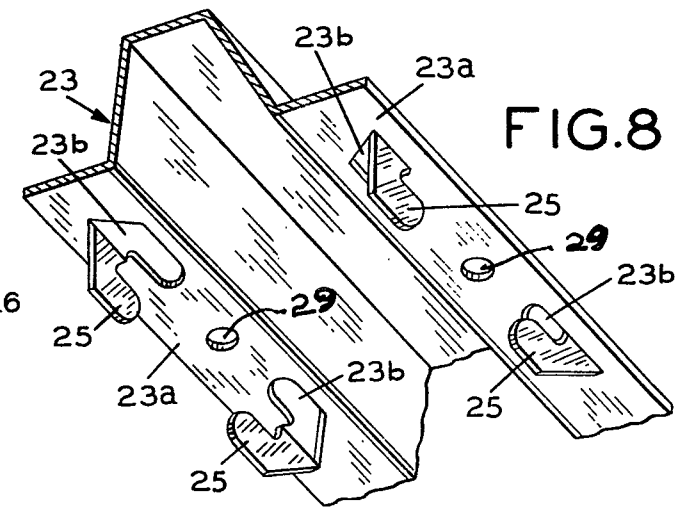
FIG. 8 is an underside perspective view of a panel support for which the modified locking member shown in FIGS. 9–12 is provided.
Figure 6:
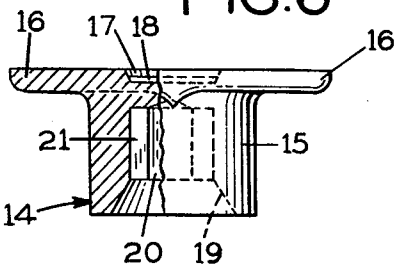
FIG. 6 is a side view of the locking member partly in section.
Figure 7:
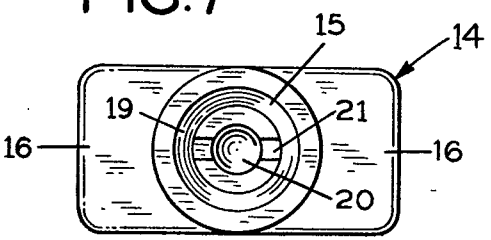
FIG. 7 is an underside plan view of the locking member.

Locking members 14, the design of which is best shown in FIGS. 5–7, serve for securing the panels 13 in their position of attachment. Each locking member 14 has a center portion 15 of approximately cylindrical dimensions and, at one end of the latter, two diametrically opposed arms 16 forming an end piece of the locking member 14. This end piece has an approximately circular recess or depression 17, the depth of which may be relatively shallow. At the center of the depression 17 and in longitudinal alignment with the two arms 16 runs a slot 18, which is essentially a groove in the depression 17 and whose side walls are beveled such that the cross-section of the slot 18 widens upward approximating a V-shaped.

At the opposite end the locking member 14 is provided with a circular depression 19 with a central bore 20 and a slot-shaped recess 21 such that a turning tool such as a screw driver may be inserted to rotate the locking member 14. Cross-sections of different shape may be used for correspondingly shaped tools.

The panel support 10 has at its lengthwise edges, in each instance between two hooks 11, the tips of which point toward each other, a web 22, which rests at the central axis of the recess or cut-out formed between the two hooks 11 at the center of the span thereof, which forms the clearance between two adjacent panels 13. The length of the web 22 is sized such that the latter fits into the depression 17 in the end-piece of the locking member 14. The latter is therefore guided by cooperation of the web 22 with the depression 17 during the rotary motion as shown by the left hand locking member in FIG. 3. Later the locking member 14 is held in a fixed location in the locked position against the panel support 10 by engagement in the slot 18 as shown by the right hand locking member 14 in FIG. 3.

Figure 2:
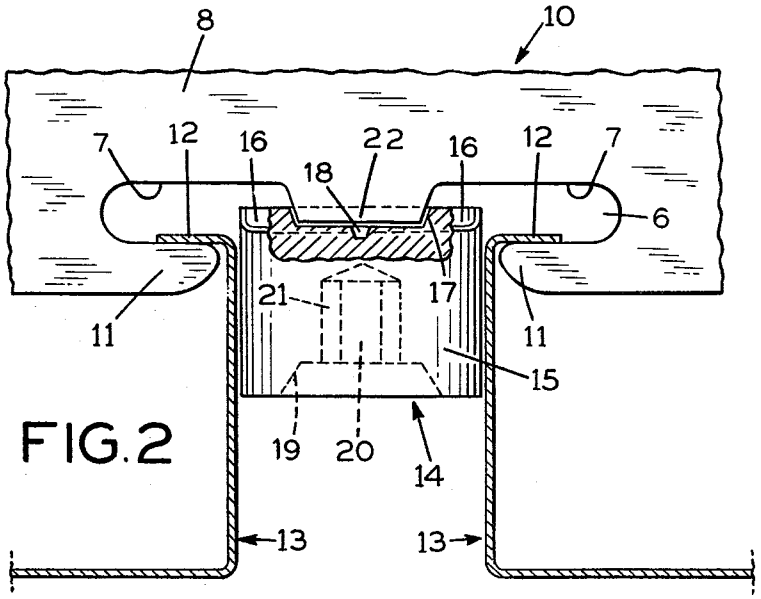
FIG. 2 is an enlarged vertical section along line 2—2 of FIG. 1.
Figure 1:
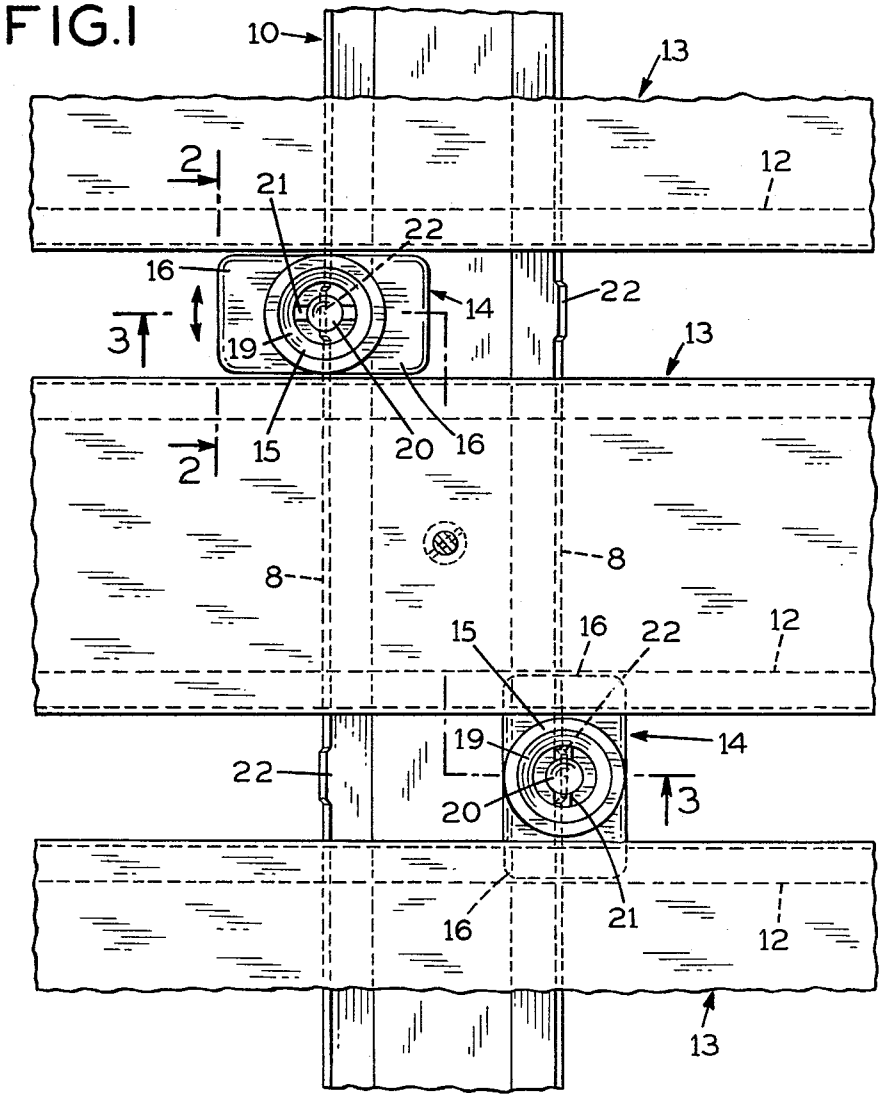
FIG. 1 is an underside plan view of a portion of a ceiling incorporating the invention.

In assembling the panels 13, the latter are accordingly first engaged over the hooks 11 on the panel support 10, so that they assume the position shown in FIGS. 1 and 2. Locking members 14 are then inserted with the arms 16 parallel with the side edges of panels 13 as shown by the unlocked member 14 in the upper left of FIG. 1 (also shown in FIG. 2 and to the left in FIG. 3). The locking members 14 are inserted until the web 22 engages depression 17 and then turned 90°. It will not always be necessary to set a locking member 14 on each available web and there clamp the panels 13 on the hooks 11. An even distribution of the locking members 14, such as alternately in staggered arrangement, as shown in FIG. 1, usually suffices.

Rotation of the locking members 14 causes the arms 16 to engage in the space 6 where they press the flanges 12 firmly onto the hooks 11. At the same time the slot 18 in the depression 17 arrives at a position in alignment with to the associated web 22 so that the latter may engage in the slot 18. By this means the locking member 14 is secured against further rotation. This locked position is shown in FIG. 1 for the lower right hand locking member 14 and is also shown to the right in FIG. 3 and in FIG. 4. As the walls of the slot 18 open obiquely upward and outward, further rotation of the locking member 14 in either direction by use of a suitable tool is possible without difficulty if disassembly is desired.

Figure 4:
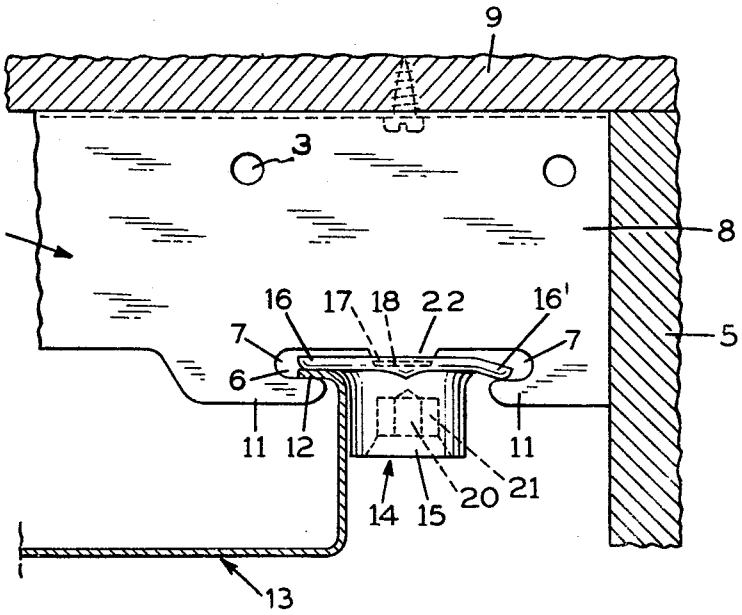
FIG. 4 is a vertical section through the panels showing the locking member in locked position and also showing how the locking member is used at the end of a panel support adjacent to a wall.
Figure 4:
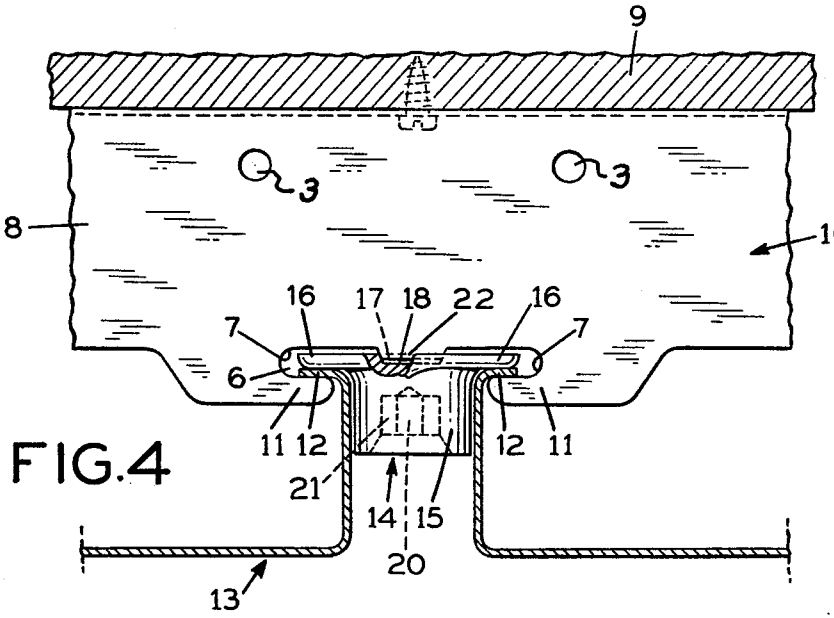

The right-hand side of FIG. 4 shows the end of a panel support 10 against a wall 5. In this latter region of attachment, however, only one panel 13 is held with the aid of the locking member 14.

In order to achieve even and reliable fit of the locking member 14 at this position, one of the arms 16′, which does not have an associated panel 13, is bent downward as shown in FIG. 4, so that it maintains the locking member 14 in a straight or upright position even though resting directly on the bearing surface a the hook 11. When the locking member 14 is manufactured, for example, of synthetic material, heating to the necessary extent may take place before the bending of said arm 16′, or the system may use two types of locking members 14, one with the arms 16 in the same plane and one initially formed with one bent arm 16′.

In the modification of FIGS. 8–12, there is shown a panel support 23 whose approximately U-shaped cross-section is now supplemented by two side flanges 23*a* bent outward in a plane parallel to that of the panel 13; the said flanges 23*a* form bearing surfaces for locking members 24, while hooks 25 have been produced for example, by punching out and bending over the side flanges 23*a* at spaced points therealong, thus forming openings 23*b* in the side flanges 23*a*.

The locking member 24 likewise again has a center portion 26 and two arms 27 corresponding to the locking member 14. The end of the locking member 24 facing the panel support 23, however, has in the region of the center portion 26 a centering pin 28, which engages in a bore 29 correspondingly sized and arranged in the side flange 23*a*, in such manner that it forms an axis of rotation for the locking member 24. This end of the locking member 24 is additionally provided with an annular shoulder 30 surrounding the centering pin, which shoulder serves as a spacer and causes the center portion 26 of the locking member 24 to remain a selected distance from the side flange 23*a*. As a result, the arms 27 are capable of bending resiliently upon engaging between the in-turned flanges 12 and the side flange 23*a*. The pressing action of the arms 27 is thereby improved, while at the same time the friction during rotation of the locking members 24 is somewhat reduced.

Figure 11:
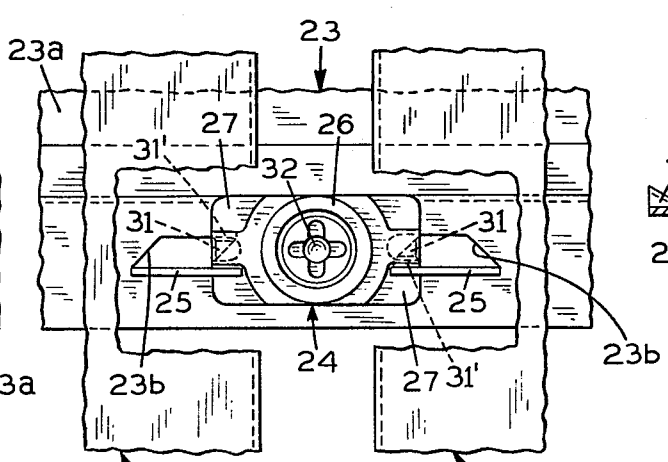
FIG. 11 is a view like FIG. 10 but showing the modified locking member in locked position.
Figure 10:
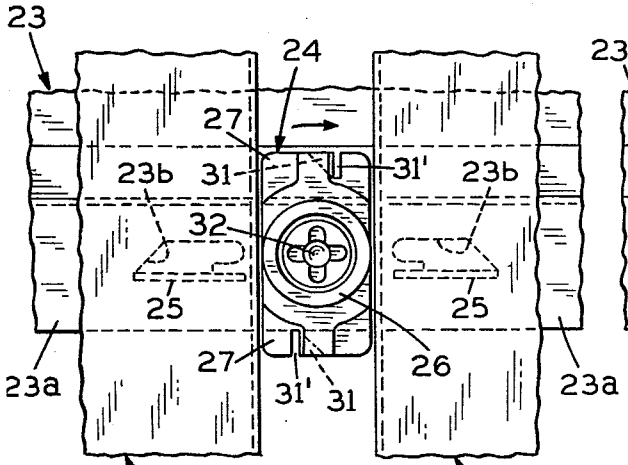
FIG. 10 is an underside plan view of FIG. 9 showing the modified locking member before being rotated into locked position.

At their ends the arms 27 are provided with stops 31. The latter are formed by notching the edge of each arm to provide a notch 31' lying in the plane of the drawing in FIGS. 10 and 11 then bending (downward in FIGS. 10 and 11) obliquely at one edge of the notch. These stops 31 engage in recesses or openings in the panel support 23, which may preferably be the same openings **23*b* in the side flanges 23*a*, produced by the formation of the hooks 25. The stops 31, by reason of their above-described shape, have a certain resiliency, so that it is always possible to release the locking member 24 by rotation in a direction opposite of that of the arrow in FIG. 10. In FIG. 10 the locking member 24 is shown in an initial position, in which it rests against the side flanges 23*a*, while the locked position is shown in FIG. 11, after a rotation of 90° in the direction of the arrow of FIG. 10**.

It is, however, possible to provide a locking mechanism formed here by the stops 31 alternatively by other means, for example by producing (such as by embossing) projection-like elevations which may engage in associated depressions, wherein it is immaterial whether the depressions of the projections are provided in the edge flange 23 and in the locking member 24, respectively, or vice versa.

The center portion 26 of the locking member 24 is provided with a recess or depression 32, which by reason of its shape is suitable for receipt of a turning tool. The shape of the depression 32 may be selected such that it is suitable selectively for the application of a screw driver, allen wrench, or the like.

Figure 13:
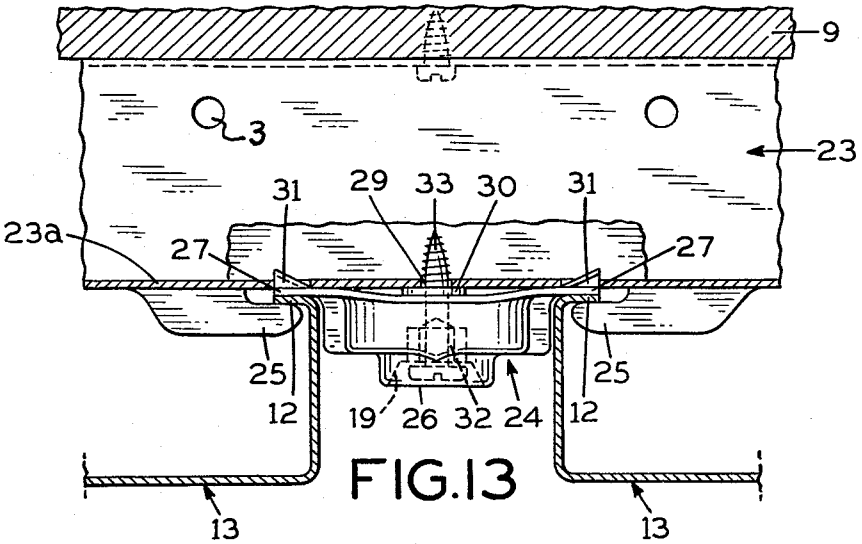
FIG. 13 is a modified form of the locking member of FIG. 12 shown in locked postion between two adjacent panels.
Figure 9:
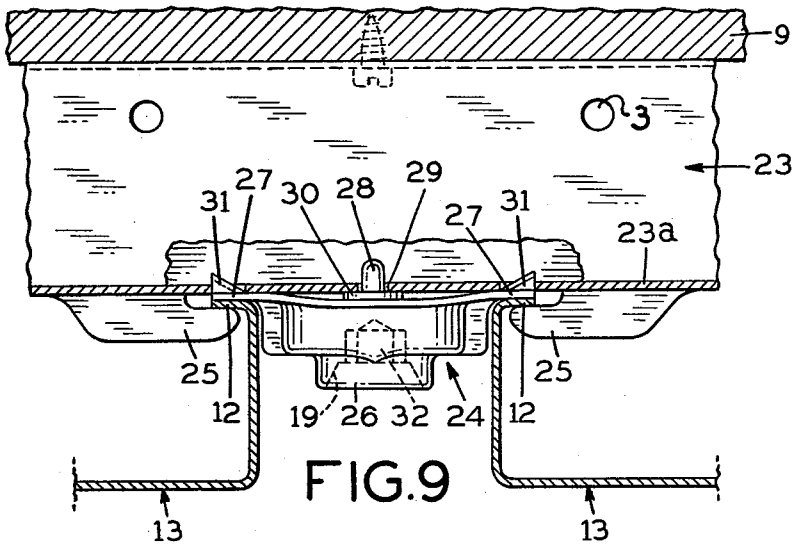
FIG. 9 is a view similar to FIG. 4 but showing the modified locking member in use with the panel support of FIG. 8.
Figure 12:
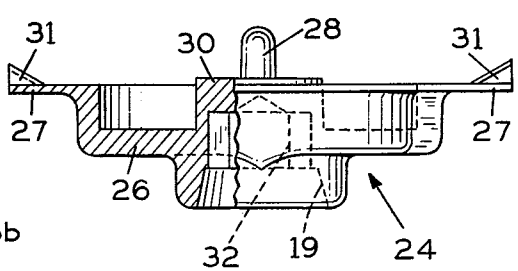
FIG. 12 is an enlarged elevational view, partly in section, of the modified locking member of FIGS. 9 through 11.

The depression 32 may, however, also be bored through or have only a very thin bottom partition, so that the insertion of a screw 33 is possible (see FIG. 13). The latter may, for example, be designed as a self-tapping screw and be fixed by tightening in a corresponding bore in the edge flange **23*a***.

It is entirely within the scope of the invention, however, to use locking members having only one arm and, for example, to attach in the region of attachment of two adjacent panels, at a particular spot of a panel support, one panel with one locking member and the other panel with another locking member each with only one arm. The operability of the locking member is in any case assured, even without the second arm.

I claim:

1. A suspension system for mounting panels to a generally planar surface of a building comprising a plurality of elongated, generally parallel panel supports; each of said panel supports being supported by said surface; and elongated panel; said panel having along each longitudinal side thereof an in-turned flange facing the in-turned flange of the opposite side; the material of said panel being sufficiently resilient to permit said flanges to be sprung apart; said panel being arranged with its length substantially transverse to the length of the panel supports; said panel supports having hooks; the flanges of said panel being engaged over said hooks; a locking member having a body portion with two ends; said locking member being positioned adjacent a longitudinal side of a panel with one end bearing against a panel support; said one end having a laterally extending arm; said locking member being rotatable to move said arm between unlocked and locked positions; said arm, when in locked position, extending over and bearing firmly against an in-turned flange of a panel to press said flange securely against its associated hook.

2. The suspension system of claim 1 in which said one end of said locking member has a generally circular depression therein, an elongated groove in the bottom of said depression, a guiding and locking element extending toward said locking member from said panel support, said element being dimensioned to fit into said groove when said arm is in said locked position, and said element guidingly engaging in said depression in all positions of said arm other than said locked position.

3. The suspension system of claim 2 in which said hook and said guiding and locking element are of such shape, dimension and relationship as to permit their formation by a single manufacturing operation performed on said panel support.

4. The suspension system of claim 2 in which the sides of said groove diverge outwardly to facilitate entry and exit of said element in said groove during rotation of said locking member.

5. The suspension system of claim 4 in which a pair of panels are supported from said panel supports with their in-turned flanges engaged with hooks and with their adjacent sides spaced apart, the body portion of said locking member is positioned in said space between said adjacent sides, and the dimension of said body portion is such as to bear against both of said adjacent side edges when said arm is in locked position.

6. The suspension system of claim 5 in which said one end has a second laterally extending arm extending outwardly therefrom in a direction opposite to said first mentioned arm, and when said arms are in locked positions said first arm bears against an in-turned flange of one of said pair of panels and said second arm bears against an in-turned flange of the other of said pair of panels to hold said flanges against their respective hooks.

7. The suspension system of claim 6 in which the length of said groove is substantially in alignment with the length of said arm.

8. The suspension system of claim 7 in which the end of said locking member opposite said one end has means for engagement by a turning tool for rotating said locking member.

9. The suspension system of claim 1 in which said panel support and said locking member each have a locking element, said locking elements being mutually engagable for releasably locking said locking member in locked position.

10. The suspension system of claim 9 in which the locking element of said panel support includes an opening in said panel support, the locking element of said locking member comprises a stop, and said stop being engaged in said opening in the locked position of said locking member.

11. The suspension system of claim 10 in which said stop is positioned on said arm.

12. The suspension system of claim 11 in which said arm is of metal and said stop comprises a notch in said arm and a portion of the margin of said notch is bent out of the plane of said arm.

13. The suspension system of claim 11 in which said stop includes a tapered ramp to permit unlocking said locking member.

14. The suspension system of claim 1 in which said arm is resilient, a shoulder on said one end of said locking member, and said shoulder bears against said panel support for increasing the pressure of said arm against its associated in-turned flange.

15. The suspension system of claim 14 in which said panel support has an opening therein, and said one end of said locking member has a post extending therefrom and through said opening in said panel support for guiding rotation of said locking member.

16. The suspension system of claim 14 in which said panel support has an opening therein, and said one end of said locking member has a screw extending therethrough and engaged in said hole in said panel support.

* * * * *